US010113846B2

(12) United States Patent
Pitre et al.

(10) Patent No.: US 10,113,846 B2
(45) Date of Patent: Oct. 30, 2018

(54) SYSTEMS AND METHODS FOR REDUCING MUNITION SENSITIVITY

(71) Applicant: General Dynamics Ordnance and Tactical Systems—Canada, Inc., Repentigny (CA)

(72) Inventors: Sylvain Pitre, Dollard-des-Ormeaux (CA); André Goulet, Québec (CA)

(73) Assignee: General Dynamics Ordnance and Tactical Systems-Canada, Inc., Repentigny (CA)

( * ) Notice: Subject to any disclaimer, the term of this patent is extended or adjusted under 35 U.S.C. 154(b) by 0 days.

(21) Appl. No.: 15/204,837

(22) Filed: Jul. 7, 2016

(65) Prior Publication Data

US 2018/0010897 A1 Jan. 11, 2018

(51) Int. Cl.
*F42B 39/20* (2006.01)
*F42B 5/28* (2006.01)

(52) U.S. Cl.
CPC ..... *F42B 39/20* (2013.01); *F42B 5/28* (2013.01)

(58) Field of Classification Search
CPC .... F42B 5/26; F42B 5/28; F42B 39/18; F42B 39/20; F42B 39/24; F42B 39/30
USPC ..... 206/3; 89/1.81, 1.817; 102/460–464
See application file for complete search history.

(56) References Cited

U.S. PATENT DOCUMENTS 2,425,472 A * 8/1947 Hodgson ..... F42B 3/26 206/3
3,750,578 A 8/1973 Blajda
4,084,512 A 4/1978 San Miguel
4,359,925 A 11/1982 Abet et al.
4,458,482 A 7/1984 Vetter et al.
4,478,151 A 10/1984 Vetter et al.
4,535,697 A * 8/1985 Moser ..... F42B 5/28 102/464
4,681,038 A 7/1987 Washburn
4,986,186 A * 1/1991 LaRocca ..... F42B 5/26 102/464
5,035,182 A 7/1991 Purchell et al.
5,048,423 A 9/1991 Garrett
5,095,821 A * 3/1992 Merz ..... F42B 12/26 102/389
5,129,326 A 7/1992 Brogan
5,155,298 A 10/1992 Koontz
5,228,285 A 7/1993 Van Name et al.
5,309,842 A 5/1994 Matysik et al.
5,311,820 A 5/1994 Ellingsen
5,337,672 A 8/1994 Boissiere et al.
5,398,498 A 3/1995 Mort et al.
(Continued)

*Primary Examiner* — Bryon Gehman
(74) *Attorney, Agent, or Firm* — LKGlobal

(57) ABSTRACT

A container (e.g., an ammunition casing, a rocket housing, or the like) includes a body structure having a wall defining a cavity configured to accept an energetic material, the body structure having a central region situated longitudinally between a first side region and a second side region, wherein the wall within the central region has a thickness that is less than the thickness of the wall within first region and either less than or equal to the thickness within the second side region. A strength reduction pattern is formed at least partially within the central region of the wall such that the strength reduction pattern provides a preferred rupture path when the energetic material is subjected to a predetermined external stimulus.

17 Claims, 7 Drawing Sheets

(56) References Cited

U.S. PATENT DOCUMENTS

| | | | | |
|---|---|---|---|---|
| 6,038,979 | A | 3/2000 | Watson et al. | |
| 6,321,656 | B1 | 11/2001 | Johnson | |
| 6,457,603 | B1 | 10/2002 | Freist et al. | |
| 6,952,995 | B2 | 10/2005 | Friedlander, III | |
| 7,051,511 | B2 | 5/2006 | Prytz | |
| 7,107,909 | B2 | 9/2006 | Haeselich | |
| 7,549,375 | B2 | 6/2009 | Cook et al. | |
| 7,739,956 | B2 | 6/2010 | Ljungwald et al. | |
| 8,082,846 | B2 | 12/2011 | Cook et al. | |
| 8,297,192 | B2 | 10/2012 | Hays et al. | |
| 8,322,286 | B2 | 12/2012 | Toreheim et al. | |
| 8,381,656 | B1 | 2/2013 | Woo et al. | |
| 8,550,004 | B1 | 10/2013 | Woo et al. | |
| 8,561,543 | B2 * | 10/2013 | Burrow | F42B 5/30 102/466 |
| 8,573,127 | B2 | 11/2013 | Sullivan et al. | |
| 8,616,131 | B2 | 12/2013 | Kaddour et al. | |
| 8,833,591 | B2 | 9/2014 | Kotevski et al. | |
| 8,875,633 | B2 | 11/2014 | Padgett | |
| 8,919,254 | B2 | 12/2014 | Diehl et al. | |
| 8,925,463 | B1 | 1/2015 | Sullivan et al. | |
| 9,182,204 | B2 * | 11/2015 | Maljkovic | F42B 33/10 |
| 9,188,412 | B2 * | 11/2015 | Maljkovic | F42B 5/26 |
| 9,329,004 | B2 * | 5/2016 | Pace | F42B 5/26 |
| 2016/0116263 | A1 * | 4/2016 | Engmann | F42B 39/24 206/3 |

* cited by examiner

A-A

A-A

801

802

803

804

809

810

811

812

813

SYSTEMS AND METHODS FOR REDUCING MUNITION SENSITIVITY

TECHNICAL FIELD

The technical field generally relates to the design of munitions. More particularly, the technical field relates to systems and methods for reducing the sensitivity of munitions and other such components to unwanted external stimuli, such as fire, slow heating, inadvertent impact, and the like.

BACKGROUND

Recent years have seen an increased interest in Insensitive Munitions (IM) that reduce the probability of inadvertent activation and/or reduce the level of reaction when the munition is subjected to unwanted stimuli, such as a fire, slow heating, or bullet/fragment impact, and which furthermore are designed to minimize collateral damage in the event of an inadvertent activation.

Prior art techniques for reaching low vulnerability (LOVA) reactions are unsatisfactory in a number of respects. For example, some designs involve equipping ammunition with relatively expensive LOVA energetic materials. In other designs, complex and expensive rupture mechanisms are incorporated to release excessive and instantaneous pressure. In others, the designs include complex and expensive mechanisms comprising fusible materials allowing for the release of pressure buildup. While some designs have incorporated rupture mechanisms, such as preferred fracture patterns along a longitudinal axis of the munition, empirical testing of such designs indicate that inadvertent activation may still cause a large number of shrapnel segments and significant collateral damage when non-LOVA energetic materials such as single or multi-base propellants are used.

Accordingly, there is a long-felt need for robust, cost-effective methods of reducing the sensitivity of munitions (and other containers holding energetic material) to external stimuli such as fire, slow heating, and impact. Other desirable features and characteristics of the present invention will become apparent from the subsequent detailed description and the appended claims, taken in conjunction with the accompanying drawings and the foregoing technical field and background.

SUMMARY OF THE DISCLOSURE

In accordance with one embodiment, a container comprises a body structure including a wall defining a cavity configured to accept an energetic material, the body structure having a central region situated longitudinally between a first side region and a second side region, wherein the wall within the central region has a thickness that is less than the thickness of the wall within the first region and either less than or equal to the thickness of the wall within the second side region. A strength reduction pattern is formed at least partially within the central region of the wall such that the strength reduction pattern provides a preferred rupture path when the energetic material is subjected to a predetermined external stimulus, wherein the preferred rupture path diverges at least in part from the longitudinal axis.

In accordance with one embodiment, a method of manufacturing a container includes first forming a body structure that includes a wall defining a cavity configured to accept an energetic material such that the body structure has a central region situated longitudinally between a first side region and a second side region, wherein the wall within the central region has a thickness that is less than the thickness of the wall within the first region and either less than or equal to the thickness of the wall within the second side region. The method further includes forming a strength reduction pattern at least partially within the central region of the wall such that the strength reduction pattern provides a preferred rupture path when the energetic material is subjected to a predetermined external stimulus, wherein the preferred rupture path diverges at least in part from the longitudinal axis.

BRIEF DESCRIPTION OF THE DRAWINGS

The exemplary embodiments will hereinafter be described in conjunction with the following drawing figures, wherein like numerals denote like elements, and wherein.

DETAILED DESCRIPTION

In general, the subject matter described herein relates to improved, cost-effective methods for reducing the sensitivity of munitions and other containers holding energetic material.

As a preliminary matter, there is no intention to be bound by any expressed or implied theory presented in the preceding technical field, background, brief summary or the following detailed description. Embodiments of the present disclosure may be described herein in terms of functional and/or logical block components and various processing steps. In addition, those skilled in the art will appreciate that embodiments of the present disclosure may be practiced in conjunction with any number of systems, and that the container designs described herein are merely various exemplary embodiments of the present disclosure. For the sake of brevity, conventional techniques related to the behavior of energetic material (such as propellants), ammunition manufacturing, metalworking, strength of materials, and other functional aspects of the systems (and the individual operating components of the systems) may not be described in detail herein.

Figure 1:
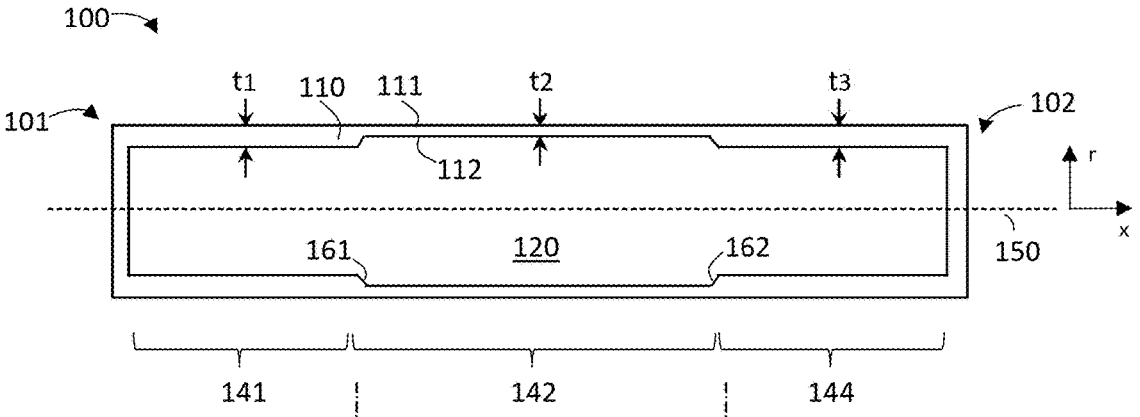
FIG. 1 is a conceptual cross-sectional view of a container in accordance with one embodiment.

Referring now to FIG. 1, a container 100 in accordance with various embodiments will now be described. In general, container 100 (which corresponds to any enclosure configured to contain an energetic material) to a body structure as shown extending from a first end 101 to a second 102 along a longitudinal axis 150. A wall 100 defines a cavity 120 configured to accept an energetic material. Wall 110 has an exterior surface 111 and an interior surface 112. Container 100 includes a central region 142 situated longitudinally between a first side region 141 and a second side region 144, wherein the wall 100 within the central region 142 has a thickness (t2) that is less than the thickness (t1) of the wall within the first region 141 and either less than or equal to the thickness (t3) of the second side region 144. The transitions between regions 141, 142, and 144 may include one or more tapered regions 161, 162 as shown. While the difference in thickness is depicted in FIG. 1 as material removed from interior surface 112, the invention is not so limited. Furthermore, while FIG. 1 generally depicts a cylindrical container 100, it will be appreciated that the invention is not so limited, as described in further detail below.

Figure 2:
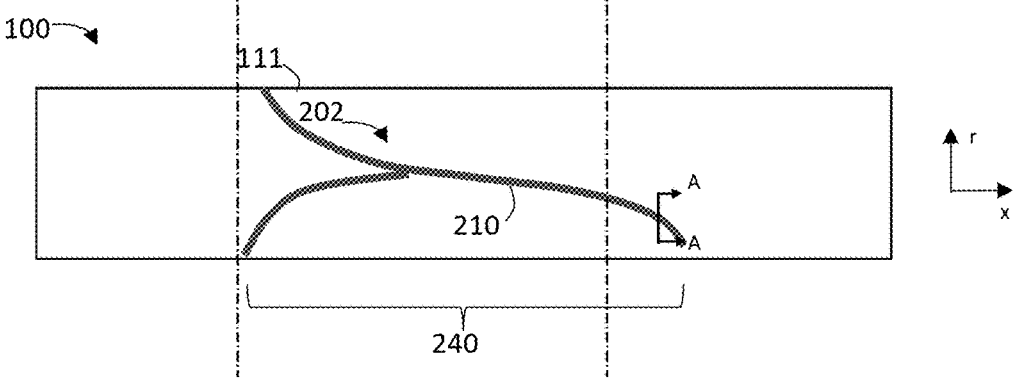
FIG. 2 is a side view of a container in accordance with FIG. 1, illustrating an exemplary strength reduction pattern.

Referring now to FIG. 2, container 100 further includes a strength reduction pattern (or "tear pattern") 202 formed at least partially within the central region 142 of the wall such that the strength reduction pattern provides a preferred rupture path when the energetic material is subjected to a predetermined external stimulus. As described in further detail below, the preferred rupture path preferably diverges at least in part from the longitudinal axis 150. As shown in FIG. 2, for example, strength reduction pattern 202 may be configured as a "lambda" pattern 210 as shown that extends longitudinally along a region 240 (and which overlaps to some degree with central region 142). As illustrated, portions of the lambda pattern 210 diverge from the longitudinal axis 150, curving to some extent circumferentially around the exterior surface 111 of container 100.

In one embodiment, the wall 110 within the central region 142 has a thickness that is reduced from 25% to 45% and that is approximately 45% to 55% of the thickness of the wall in the first side region 141, and a thickness that is approximately 70% to 100% of the thickness of the wall in the second side region 144. As an example, the thickness of the central region 142 of a crimped brass cartridge case filled with single base propellant would need to be approximately 55% to 75% the thickness of the central region of a typical case, in order to sustain the stresses associated with the loading and the firing of the ammunition in an automatic weapon system and at the same time for the case to be weak enough to obtain the desired reaction when exposed to undesired external stimuli.

Figure 3A:
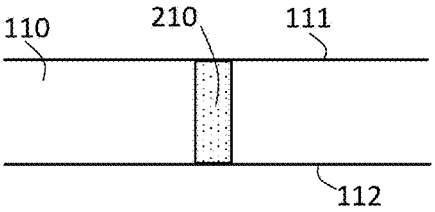
FIGS. 3A and 3B are cross-sectional close-up views of the strength-reduction pattern in accordance with various embodiments.
Figure 3B:
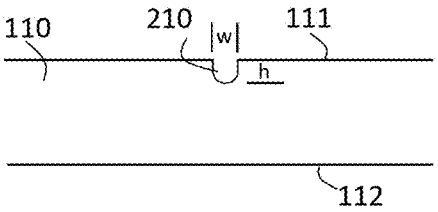

Strength reduction pattern 202 may be produced in a number of ways. FIGS. 3A and 3B, for example, are cross-sectional close-up views of the strength-reduction pattern 202 of FIG. 2. Referring to FIG. 3A, in one embodiment the strength reduction pattern includes a pattern of material 210 having a material with reduced tensile or yield strength properties or a removal of material that locally reduces its ability to sustain stress, or a combination of the two. That is, the material 210 is in "weaker" in tension and/or bending than the surrounding material of wall 110. The strength reduction pattern 202 may be formed, for example, via mechanical, chemical, thermal processes or the combination of any of these, such as localized annealing, localized machining, localized abrasion by water jet or other common processes.

Figure 4:
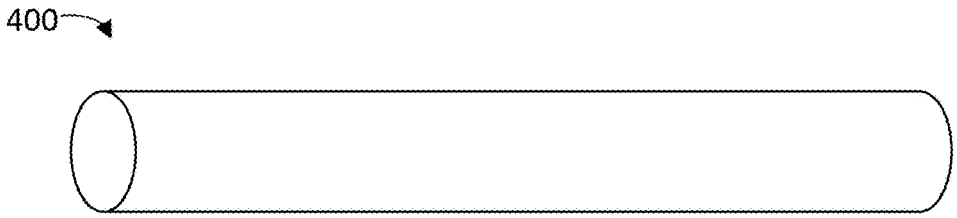
FIGS. 4-7 are external views of exemplary container shapes in accordance with various embodiments.
Figure 5:
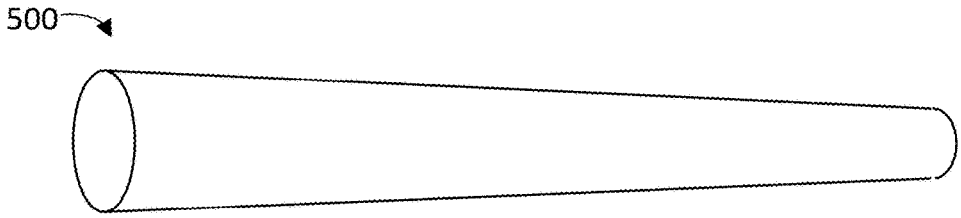
Figure 6:
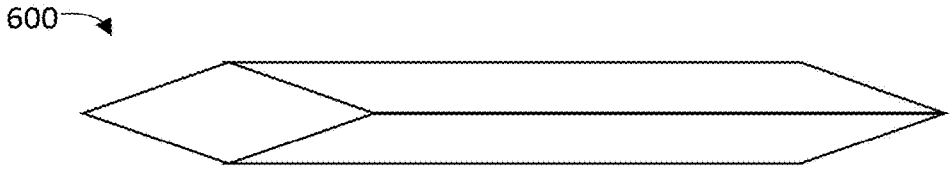

In another embodiment, as shown in FIG. 3B, the pattern 210 corresponds to a pattern of reduced material in the wall 110 of container 100. In FIG. 3B, for example, a "notch" (having, in this embodiment, a width w and a height h) or any other such shape has been formed in the exterior wall 110. In other embodiments, such a notch may be formed on the inner surface 112. In other embodiments, a combination of the techniques shown in FIGS. 3A and 3B may be used in conjunction with each other to form As mentioned above, the structures and methods described herein may be used in the context of any number of container shapes, not just cylindrical shapes as shown in FIG. 1. FIGS. 4-7, for example, are external views of exemplary container shapes in accordance with various embodiments. FIG. 4 depicts a traditional cylindrical container 400, as previously shown in FIG. 1. FIG. 5 depicts a conical container 500 that tapers along its longitudinal axis, and FIG. 6 depicts a polyhedral container 600.

Figure 7:
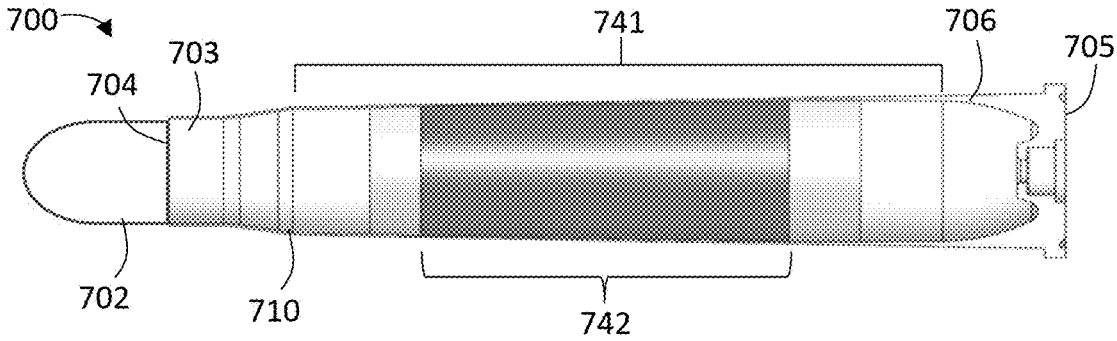

FIG. 7 depicts a particular embodiment corresponding to a shell casing 700 and projectile (or bullet) 702. As shown, shell casing 700 generally includes a mouth region 704, a neck or crimped region 703, a shoulder region 710, a base or head region 705, a under head region 706, and a body region 741 which extends from the shoulder region 710 to the under head region 706. The body region is typically inwardly tapered and typically of variable thickness, being thicker toward the base and thinner toward the mouth. Central region 742 is within the body region 741 and thus corresponds to central region 142 as shown in FIG. 1. The first region 144 extends from the central region 742 to the mouth region 704. The second region 141 extends from the central region 742 to the base region 705.

Figure 8A:
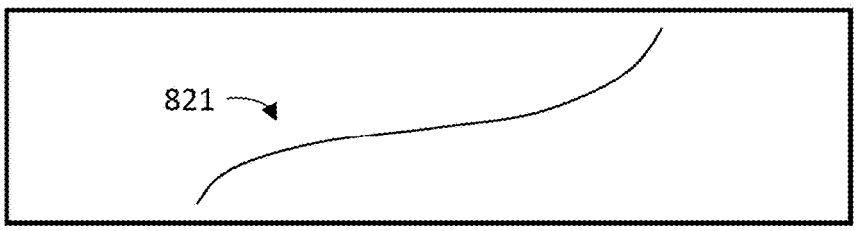
FIGS. 8A-8M are external views of exemplary strength-reduction patterns in accordance with various embodiments.
Figure 8B:
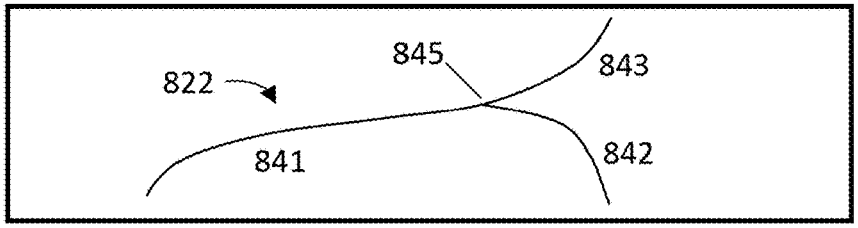

As mentioned above, strength reduction pattern 202 of FIG. 2 may have a variety of shapes and may comprise any number of linear, curved, and/or curvilinear segments having a variety of topologies. FIGS. 8A-8M, for example, are external views of exemplary strength-reduction patterns in accordance with various embodiments. FIG. 8A depicts a container 801 having a helicoidal pattern 821. FIG. 8B depicts a container 802 having a "lambda" pattern 822. Lambda pattern 822 generally includes two curvilinear segments 843, 842 that each extend radially along one end 161 of the central region 742 near the base region 705, and one curvilinear segment 841 extending towards the mouth region 704. All three curvilinear segments are intersecting at a point 845. FIGS. 9A-9D depict, in greater detail, the progression of a "lambda"-type tear as might occur in the embodiment shown in FIG. 8B. That is, tear pattern 902 resulting in tear starting at 906 and extending through 904. This pattern has found to be particularly beneficial, in that its rupture may be result in only two pieces of shrapnel being created during activation: generally shown as regions 851 and 852 in FIG. 9D.

Figure 8C:
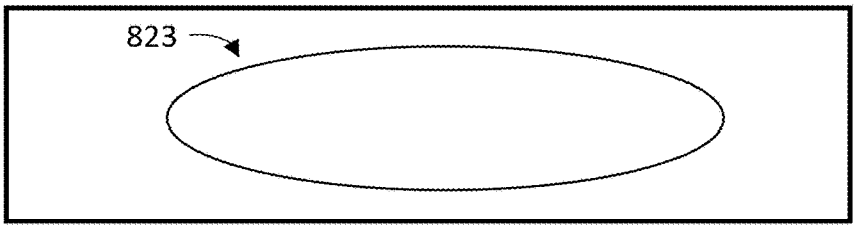
Figure 8D:
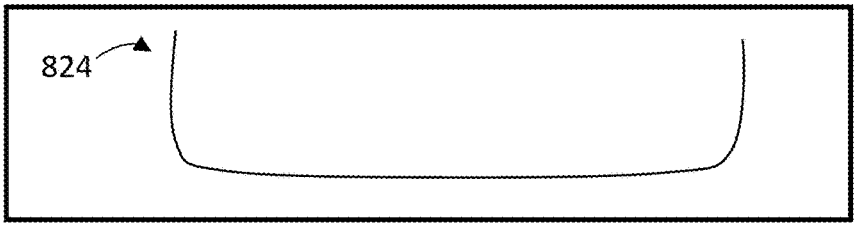
Figure 8E:
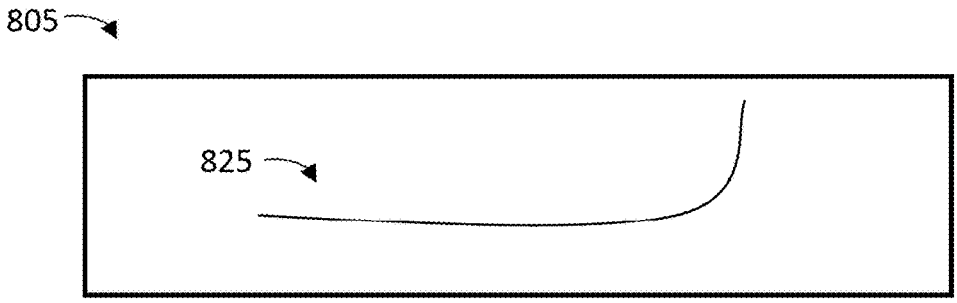
Figure 8F:
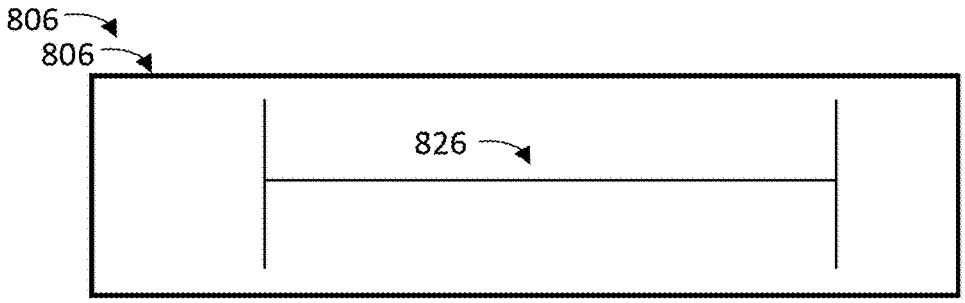
Figure 8G:
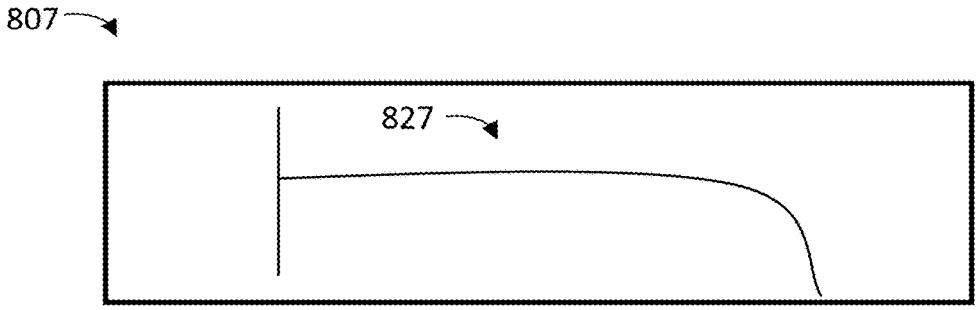
Figure 8H:
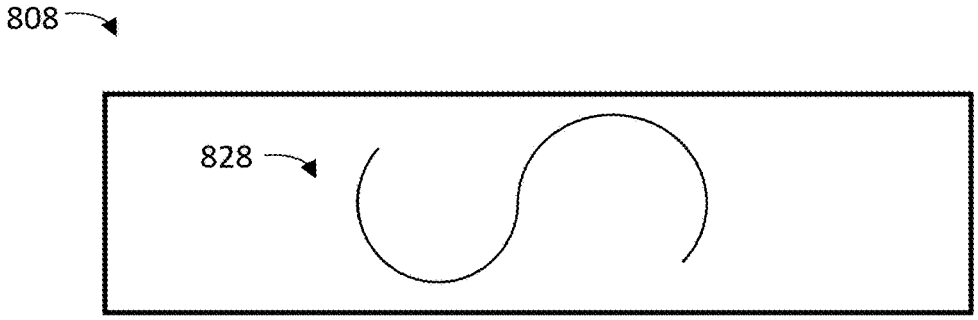
Figure 8I:
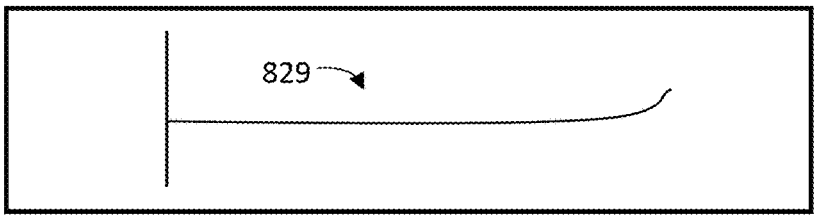
Figure 8J:
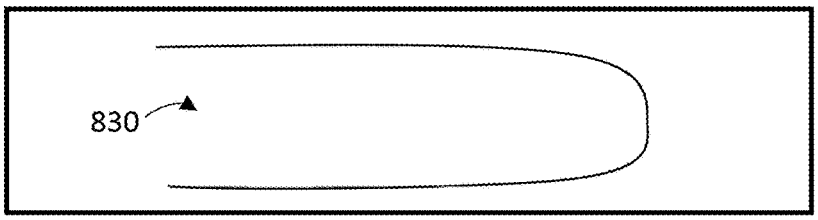
Figure 8K:
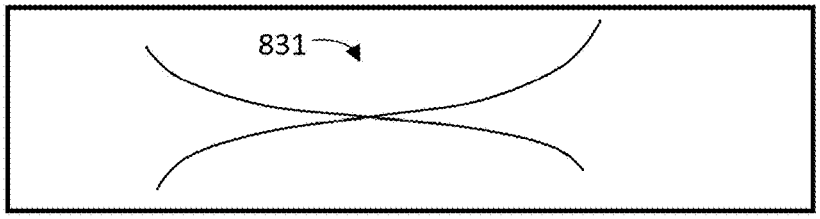
Figure 8L:
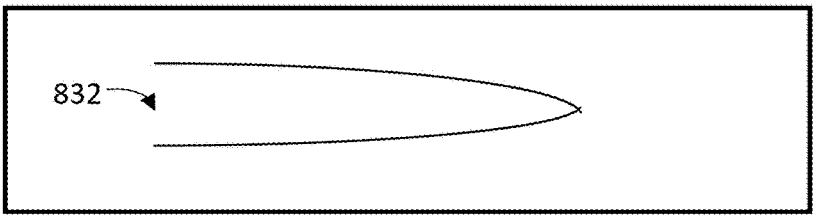
Figure 8M:
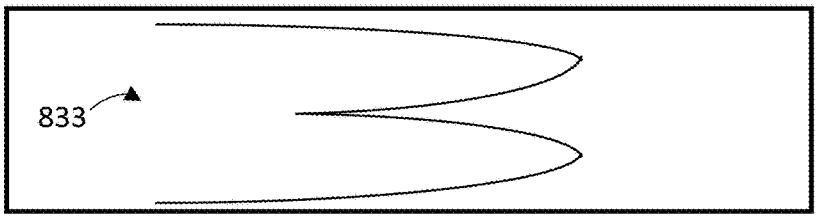
Figure 9A:
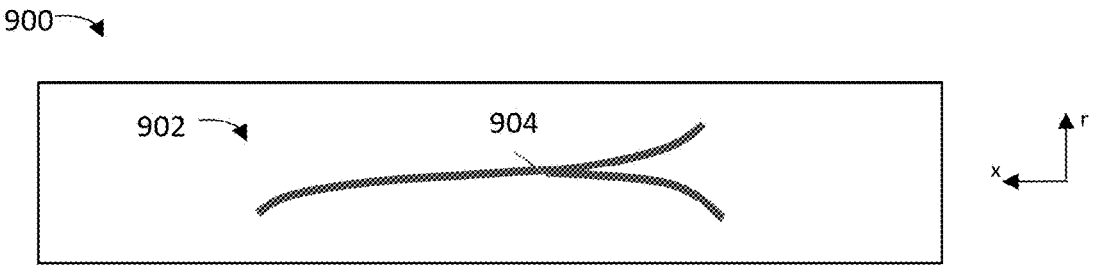
FIGS. 9A-9D depict the progression of a "lambda"-type tear.
Figure 9B:
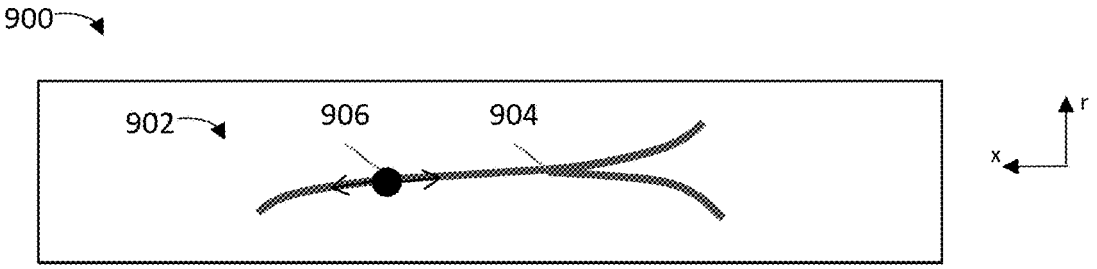
Figure 9C:
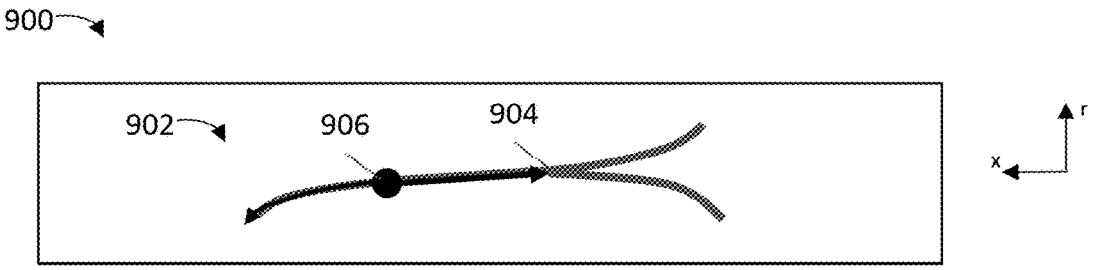
Figure 9D:
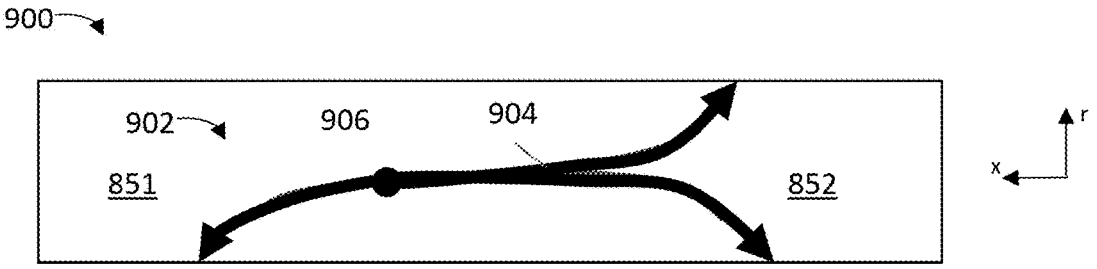

FIG. 8C depicts a container 803 with an elliptical pattern 823. FIG. 8D depicts a container 804 with a C-shaped pattern 824. Similarly, the following FIGS. 8E-8M) depict L-shaped, I-shaped, J-shaped, S-shaped, T-shaped, U-shaped, X-shaped, V-shaped, and W-shaped patterns, respectively.

Figure 10A:
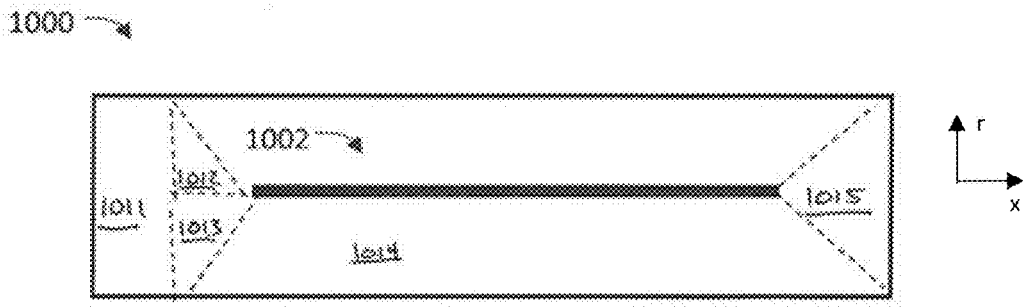
FIGS. 10A and 10B depict shrapnel fragments that might result from a simple longitudinal tear pattern.
Figure 10B:
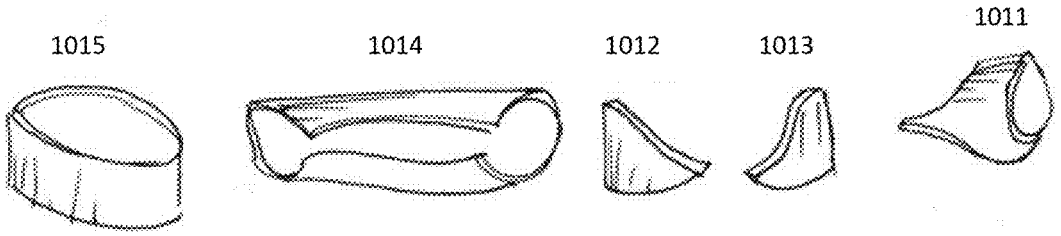
Figure 11A:
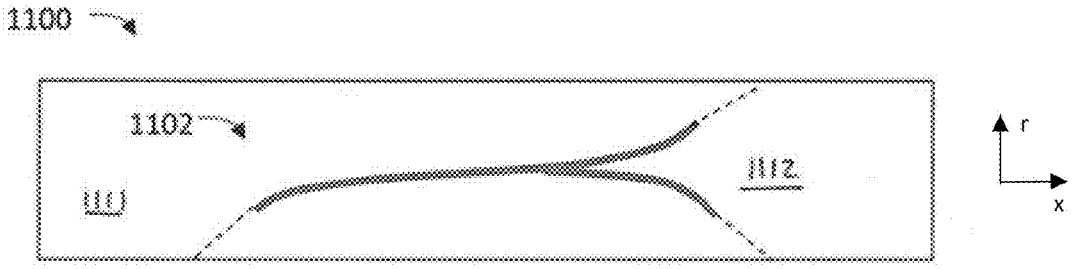
FIGS. 11A and 11B depict shrapnel fragments that might result from a "lambda"-type tear pattern.
Figure 11B:
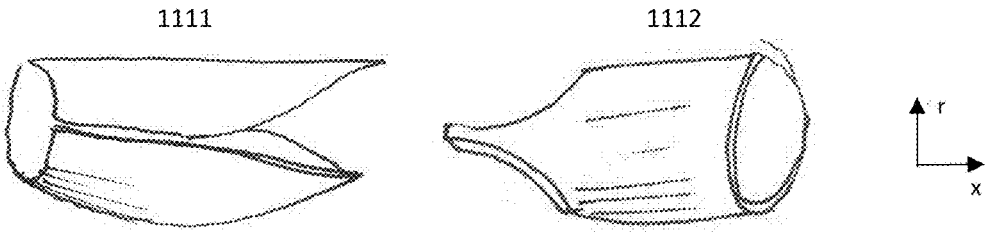

As mentioned above, one of the advantages of containers in accordance with the present invention is that activation of the energetic material will generally result in fewer shrapnel fragments. In that regard, FIGS. 10A and 10B depict shrapnel fragments that might result from a simple, prior-art, longitudinal tear pattern when non-LOVA energetic material is used; and FIGS. 11A and 11B depict shrapnel fragments that might result from a "lambda"-type tear pattern when non-LOVA energetic material such as single or multi-base propellant is used. As shown in FIG. 10, rupture along the tear pattern 1002 of container 100 can result in five or more pieces of shrapnel, generally shown as fragments 1011-1015 in FIG. 10B (and corresponding regions 1011-1015 in FIG. 10A). In contrast, FIGS. 11A and 11B depict the shrapnel fragments that might result from rupture of lambda-shaped tear pattern 1102 of container 1100. That is, rupture of such a container may result in only two fragments: 1111 and 1112 as shown. In accordance with various embodiments, the strength reduction pattern is specifically selected to produce a predefined number of fragments when the energetic material is subjected to a predetermined external stimulus. In another, the strength reduction pattern is selected such that the predefined number of fragments have predetermined masses. In yet another, the strength reduction pattern is selected such that the predefined number of fragments have predetermined geometries.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the disclosure in any way. Rather, the foregoing detailed description will provide those skilled in the art with a convenient road map for implementing the exemplary embodiment or exemplary embodiments. It should be understood that various changes can be made in the function and arrangement of elements without departing from the scope of the disclosure as set forth in the appended claims and the legal equivalents thereof.

What is claimed is:

1. A container comprising:

a body structure including a wall defining a cavity configured to accept an energetic material, the body structure having a central region situated on a longitudinal axis defined between a first side region and a second side region, wherein the wall within the central region has a thickness that is less than a thickness of the wall within the first region and either less or equal to a thickness of the wall within the second side region; and a strength reduction pattern formed at least partially within the central region of the wall such that the strength reduction pattern provides a preferred rupture path when the energetic material is subjected to a predetermined external stimulus, wherein the preferred rupture path diverges at least in part from the longitudinal axis, and wherein the strength reduction pattern is selected to produce a predefined number of fragments when the energetic material is subjected to a predetermined external stimulus.

2. The container of claim 1, wherein the wall within the central region has a thickness that is reduced from 25% to 45% and that is approximately 45% to 55% of the thickness of the wall in the first side region.

3. The container of claim 1, wherein the strength reduction pattern includes a pattern of material having a reduced tensile strength.

4. The container of claim 3, wherein the strength reduction pattern is formed via localized mechanical, chemical, thermal processes or a combination thereof.

5. The container of claim 1, wherein the body structure has a shape selected from the group consisting of cylindrical, conical, polyhedral, and ammunition casing-shaped.

6. The container of claim 1, wherein the strength reduction pattern is selected such that the predefined number of fragments have predetermined masses.

7. The container of claim 1, wherein the strength reduction pattern is selected such that the predefined number of fragments have predetermined geometries.

8. The container of claim 1, wherein the strength reduction pattern has a shape selected from the group consisting of C-shaped, L-shaped, I-shaped, J-shaped, S-shaped, T-shaped, U-shaped, V-shaped, W-shaped, X-shaped, heliocoidal, elliptical, and lambda-shaped.

9. A method of manufacturing a container, comprising:

forming a body structure that includes a wall defining a cavity configured to accept an energetic material such that the body structure has a central region situated on a longitudinal axis defined between a first side region and a second side region, wherein the wall within the central region has a thickness that is less than a thickness of the wall within the first region and either less or equal to a thickness of the wall within the second side region; and forming a strength reduction pattern at least partially within the central region of the wall such that the strength reduction pattern provides a preferred rupture path when the energetic material is subjected to a predetermined external stimulus, wherein the preferred rupture path diverges at least in part from the longitudinal axis, and wherein the strength reduction pattern is selected to produce a predefined number of fragments when the energetic material is subjected to a predetermined external stimulus.

10. The method of claim 9, wherein the wall within the central region is formed with a thickness that is reduced from 25% to 45% and that is approximately 45% to 55% of the thickness of the wall in the first side region.

11. The method of claim 9, wherein the strength reduction pattern includes a pattern of material having a reduced tensile strength.

12. The method of claim 9, wherein the strength reduction pattern is formed via localized mechanical, chemical, thermal processes or a combination thereof.

13. The method of claim 9, wherein the body structure has a shape selected from the group consisting of cylindrical, conical, polyhedral, and ammunition casing-shaped.

14. The method of claim 9, wherein the strength reduction pattern is selected such that the predefined number of fragments have predetermined masses.

15. The method of claim 9, wherein the strength reduction pattern is selected such that the predefined number of fragments have predetermined geometries.

16. The method of claim 9, wherein the strength reduction pattern has a shape selected from the group consisting of C-shaped, L-shaped, I-shaped, J-shaped, S-shaped, T-shaped, U-shaped, V-shaped, W-shaped, X-shaped, heliocoidal, elliptical, and lambda-shaped.

17. A container comprising:

a body structure including a wall defining a cavity configured to accept an energetic material, the body structure having a central region situated on a longitudinal axis defined between a first side region and a second side region, wherein the wall within the central region has a thickness that is less than a thickness of the wall within the first region and either less or equal to a thickness of the wall within the second side region; and a strength reduction pattern formed at least partially within the central region of the wall such that the strength reduction pattern provides a preferred rupture path when the energetic material is subjected to an undesired external stimulus that is not associated with the use of the container and the energetic material in a weapon system, wherein the preferred rupture path diverges at least in part from the longitudinal axis.

* * * * *